US007755456B2

(12) United States Patent
Salehi

(10) Patent No.: US 7,755,456 B2
(45) Date of Patent: Jul. 13, 2010

(54) TRIPLE-MODE CAVITY FILTER HAVING A METALLIC RESONATOR

(75) Inventor: Hamid Reza Salehi, Wallingford, CT (US)

(73) Assignee: Radio Frequency Systems, Inc, Meriden, CT (US)

( * ) Notice: Subject to any disclaimer, the term of this patent is extended or adjusted under 35 U.S.C. 154(b) by 166 days.

(21) Appl. No.: 12/102,491

(22) Filed: Apr. 14, 2008

(65) Prior Publication Data

US 2009/0256651 A1 Oct. 15, 2009

(51) Int. Cl.
*H01P 1/20* (2006.01)
*H01P 7/10* (2006.01)

(52) U.S. Cl. ..... 333/202; 333/212

(58) Field of Classification Search ..... 333/202, 333/208, 209, 219, 219.1, 212
See application file for complete search history.

(56) References Cited

U.S. PATENT DOCUMENTS 3,009,123 A 11/1961 Mims
5,969,584 A 10/1999 Huang et al.
6,873,222 B2 * 3/2005 Mansour ..... 333/99 S
2002/0130731 A1 9/2002 Mansour
2003/0137368 A1 7/2003 Saito et al.

FOREIGN PATENT DOCUMENTS

EP 0691702 A 1/1996
WO 9740546 A 10/1997

* cited by examiner

*Primary Examiner*—Dean O Takaoka
(74) *Attorney, Agent, or Firm*—Kramer & Amado P.C.

(57) ABSTRACT

A triple-mode filter is disclosed, the triple-mode filter including a cavity for confining electromagnetic waves and a metallic block acting as a resonator within that cavity. The metallic block does not contact the conductive walls of the cavity, but is instead suspended by a support element. Triple-mode resonators may be combined to produce bandpass filters having three or more poles. In other configurations, triple-mode cavity metallic resonators may be coupled to triple-mode cavity ceramic resonators or to combline resonators to achieve various filtering functions and performances suitable for different applications.

15 Claims, 9 Drawing Sheets

Triple-mode cavity filter 100

Top view of resonator 110, mounted in cavity 120

Six-pole bandpass filter 300

The passband frequency response of six-pole filter 300

The wideband frequency response of six-pole filter 300

Six-Pole Filter 610

Seven-Pole Filter 620

Eight-Pole Filter 630

Nine-Pole Filter 640

Nine-Pole Filter 650

Nine-Pole Filter 660

Twelve-Pole Filter 670

Twelve-Pole Filter 680

TRIPLE-MODE CAVITY FILTER HAVING A METALLIC RESONATOR

BACKGROUND OF THE INVENTION

1. Field of the Invention

This invention relates generally to triple-mode cavity filters for microwave and radio frequency signals and, more particularly, to cavity filters using metallic resonators.

2. Description of the Related Art

Wireless communication systems often require devices to select signals within predetermined frequency bands. When these devices are implemented as bandpass filters, users can select a desired range of frequencies, known as a passband, and discard signals from frequency ranges that are either higher or lower than the desired range. It is particularly important for bandpass filters to achieve high out-of-band rejection, attenuating signals outside the passband to emphasize the desired frequency range.

Cavity resonators are devices frequently used to implement bandpass filters. A cavity resonator confines electromagnetic radiation within a solid structure, typically formed as a rectangular parallelepiped. Other cavity shapes maybe used, such as cylinders and spheres. Because the enclosed cavity acts as a waveguide, the pattern of electromagnetic waves is limited to those waves that can fit within the walls of the waveguide. Within the cavity, the reflection of the waves can result in a variety of patterns, known as resonant modes.

In order to reduce the cost and the size, it is often necessary to replace multiple cavity resonators with a single cavity resonator. A single physical cavity can function in the same manner as two cavities if two of its resonant modes are set to the same resonant frequency, making it a dual-mode resonator. The design can be further improved by using three degenerate resonant modes. In this configuration, known as a triple-mode resonator, three resonant modes of the resonator, resonating near each other, are used to construct a filter function. In other words, one cavity accommodates three electromagnetic resonances that are employed in the construction of the filter response.

One structural design of a triple-mode resonator structure uses a dielectric cube as a resonator. While this structure produces three modes that resonate at similar frequencies, the dielectric cube resonator has a number of disadvantages. Fabrication of dielectric resonators with expensive ceramic materials would make the overall filter more costly.

The dielectric cube also tends to produce spurious resonances near the resonator's desired operating frequency. Aggressive suppression is needed to discard these unwanted frequencies. While suppression would compensate for the spurious modes, it would also greatly increase the insertion loss of the resonator. An increase in insertion loss is proportional to a decrease in transmitted power from the resonator. Therefore, the elimination of spurious modes also reduces the overall signal strength.

Accordingly, there is a need to produce a triple-mode resonator that overcomes the detrimental characteristics of the dielectric cube structure. More particularly, there is a need for a triple-mode resonator that is relatively inexpensive to manufacture and has a wide, spurious-free response.

The foregoing objects and advantages of the invention are illustrative of those that can be achieved by the various exemplary embodiments and are not intended to be exhaustive or limiting of the possible advantages which can be realized. Thus, these and other objects and advantages of the various exemplary embodiments will be apparent from the description herein or can be learned from practicing the various exemplary embodiments, both as embodied herein or as modified in view of any variation which may be apparent to those skilled in the art. Accordingly, the present invention resides in the novel methods, arrangements, combinations, and improvements herein shown and described in various exemplary embodiments.

SUMMARY OF THE INVENTION

In light of the present need for an improved triple-mode cavity resonator that is easier to design and manufacture and benefits from a reduction in cost, a brief summary of various exemplary embodiments is presented. Some simplifications and omissions may be made in the following summary, which is intended to highlight and introduce some aspects of the various exemplary embodiments, but not to limit its scope. Detailed descriptions of preferred exemplary embodiments adequate to allow those of ordinary skill in the art to make and use the inventive concepts will follow in later sections.

In various exemplary embodiments, a triple-mode cavity resonator selects a specific range of signal frequencies, the cavity resonator comprising: at least one metallic wall for defining a cavity; a metallic resonator located within the cavity without contacting the at least one metallic wall; and a support element coupling the metallic resonator to the cavity. In various exemplary embodiments, the metallic resonator is substantially cubical in shape. The cavity may be a rectangular parallelepiped having a top surface, a bottom surface, and four side surfaces.

In various exemplary embodiments, a six-pole bandpass filter having a particular bandwidth over a selected range of frequencies comprises: a first triple-mode cavity resonator; a second triple-mode cavity resonator; and an iris to couple signals between the first and second cavity resonators, wherein each of the cavity resonators comprises: at least one metallic wall for defining a cavity that confines electromagnetic waves, a metallic resonator located within the cavity without contacting the at least one metallic wall, and a support element supporting the resonator in the cavity.

In various exemplary embodiments, a multi-pole bandpass filter comprises: at least two terminals; at least one triple-pole cavity resonator comprising at least one metallic wall for defining a cavity that confines electromagnetic waves, a metallic resonator located within the cavity without contacting its at least one metallic wall, a support element supporting the resonator in the cavity; and at least two irises for coupling the cavity resonator to the terminals.

In various exemplary embodiments, the bandpass filter may comprise two triple-mode cavity resonators, each triple-mode cavity resonator having a metallic resonator, and a combline filter. The bandpass filter may also comprise two triple-mode cavity resonators, each cavity resonator having a metallic resonator, and two combline filters.

In various exemplary embodiments, the bandpass filter comprises: a first cavity resonator having a first resonator; a first iris coupling the first cavity resonator to a second cavity resonator, the second cavity resonator having a second resonator and a second iris coupling the second cavity resonator to a third cavity resonator, the third cavity resonator having a third resonator. The first, second, and third resonators may be metallic. Alternatively, the second resonator may be ceramic while the first and third resonators are metallic. Also, the second resonator may be metallic while the first and third resonators are ceramic. The first and second irises may be aligned or orthogonal.

In various exemplary embodiments, the bandpass filter may be a twelve-pole filter. This twelve-pole filter may comprise four triple-mode cavity resonators, each cavity resonator having a metallic resonator. Alternatively, the twelve-pole filter may comprise a combination of metallic and ceramic triple-mode cavity resonators.

BRIEF DESCRIPTION OF THE DRAWINGS

In order to better understand various exemplary embodiments, reference is made to the accompanying drawings, wherein.

DETAILED DESCRIPTION OF THE PREFERRED EMBODIMENTS OF THE INVENTION

Figure 1:
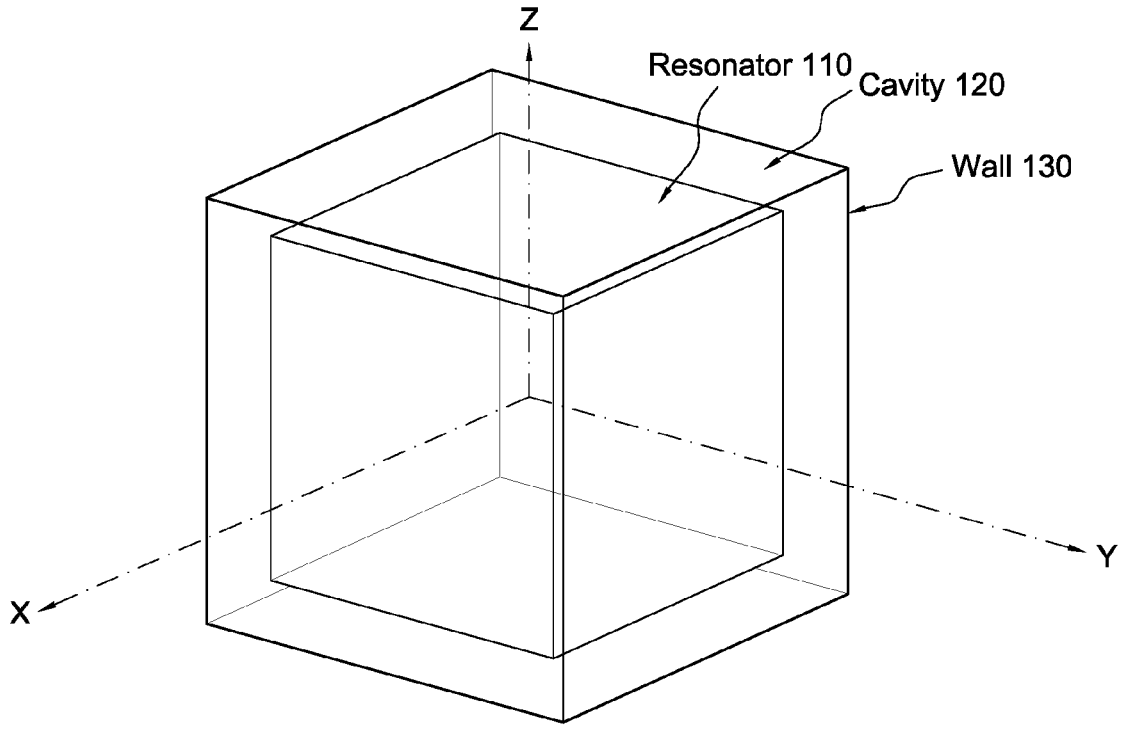
FIG. 1 is a perspective view of an exemplary triple-mode cavity resonator.

Referring now to the drawings, in which like numerals refer to like components or steps, there are disclosed broad aspects of various exemplary embodiments.

FIG. 1 is a perspective view of an exemplary triple-mode cavity resonator 100. In various exemplary embodiments, resonator 110 is a metallic block located entirely within the conductive enclosure of cavity resonator 100 having at least one wall 130 that defines a cavity 120 for confining electromagnetic waves. Resonator 110 may be entirely enclosed within cavity 120, such that resonator 110 does not touch the at least one wall 130. Cavity 120 may be implemented as a rectangular parallelepiped having a top surface, a bottom surface, and four side walls. Alternatively, cavity 120 may be cylindrical, spherical, or designed in another appropriate shape as determined by one of ordinary skill in the art.

Cavity 120 resonates at certain frequencies due to the internal reflections of electromagnetic waves at the air/metal boundary defined by at least one wall 130. While it may be convenient to fabricate wall 130 from a metal, wall 130 could also be made of another electrically conductive substance, such as metallized polymer. As the highly conductive boundary functions as an electrical short, the reflections off the boundary create a characteristic standing wave pattern having a specific electromagnetic field distribution at a unique frequency Accordingly, the higher order resonant frequencies of the triple-mode conductor-loaded resonator are considerably further away from the operating band of the filter in comparison to the higher order resonant frequencies of the ceramic resonator, thereby providing a much wider spurious-free window.

Figure 2:
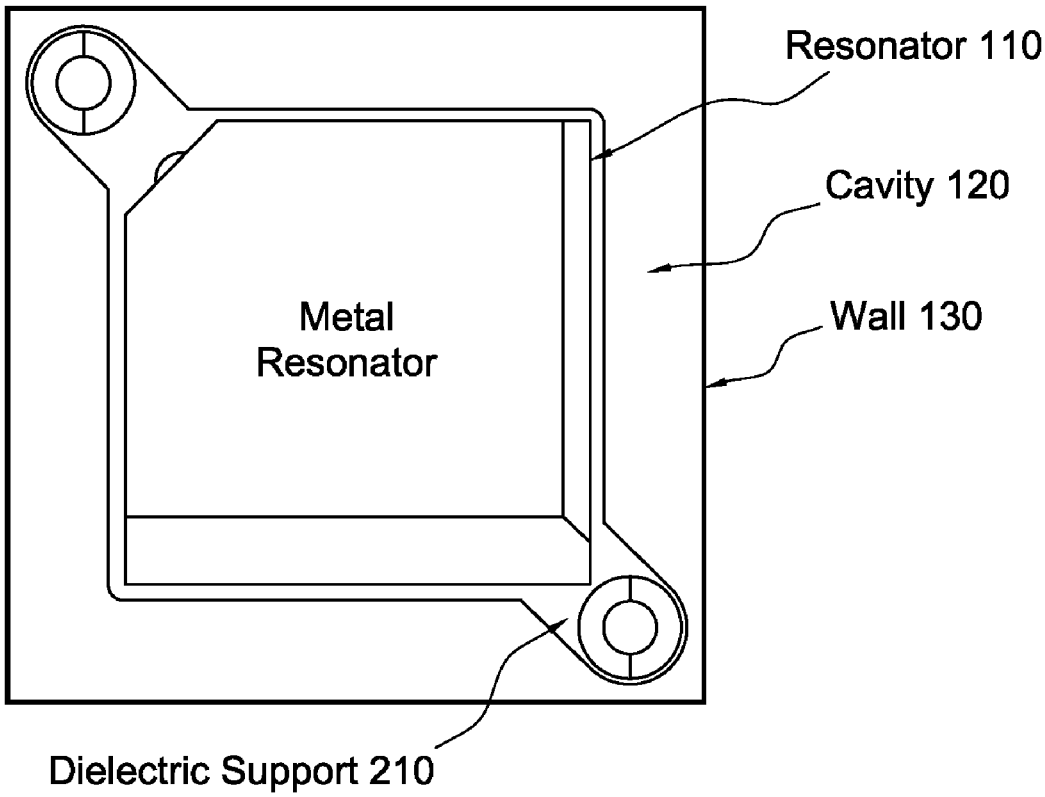
FIG. 2 is a top view of an exemplary mounting of the resonator of FIG. 1 in a cavity.

FIG. 2 is a top view of an exemplary mounting of resonator 110 of FIG. 1 in cavity 120. In various exemplary embodiments, resonator 110 is substantially shaped as a cube, having six squares as its faces. However, one vertex of this cube may be truncated in Order to better couple resonator 110 to at least one wall 130 of cavity 120. One or several vertices of this cube may be truncated in order to achieve the desired electromagnetic coupling, necessary to construct the filter function, between the three resonant modes of the triple-mode cavity resonator. The truncations of the various vertices, cuts in the form of chamfers or other forms, may achieve different coupling values for the cavity.

The bottom side of dielectric support 210 is mounted on at least one wall 130 of cavity 120. Resonator 110 may contact the top side of dielectric support 210 at both the truncated vertex of the cube and at a second vertex, located diametrically opposite the truncated vertex on the bottom face of resonator 110. Thus, dielectric support 210 may couple resonator 110 to at least one wall 130 of cavity 120 without having any contact between these conductive surfaces.

Because resonator 110 should be suspended within cavity 120, support 210 maintains the position of resonator 110 during thermal and vibratory variations. Support 210 should have adequate heat transfer capability and minimal impact on the performance of triple-mode filter 100. Thus, in various exemplary embodiments, support 210 is fabricated from a material having a low dielectric constant, such as ceramic. It should be apparent that other suitable materials may be used for support 210.

In various exemplary embodiments, cavity 120 has a parallelepiped shape. Thus, in these embodiments, support 210 may be mounted from any of the six sides of cavity 120. Support 210 may consist of a single-side support or an opposing support design to sandwich resonator 110 into position. Either way, support 210 must locate resonator 110 in a repeatable fashion during assembly of triple-mode filter 100.

Figure 3:
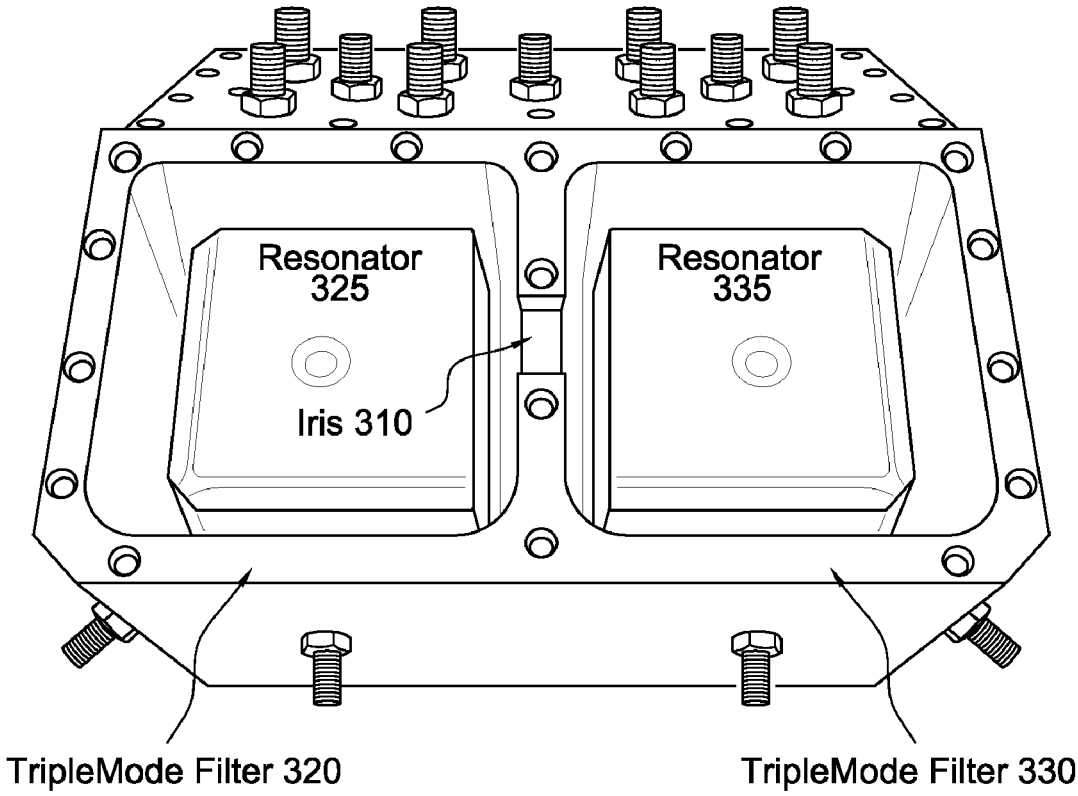
FIG. 3 is a perspective view of an exemplary six-pole triple-mode bandpass filter.

FIG. 3 is a perspective view of an exemplary six-pole bandpass filter 300. In various exemplary embodiments, two triple-mode cavity resonators 100 of the type depicted in FIG. 1 may be combined to form a six-pole bandpass filter 300. In one embodiment, iris 310 may couple signals from cavity filters 320 and 330. Resonator 325 within cavity resonator 320 may be arranged to be orthogonal to resonator 335 of cavity resonator 330. While dielectric support 210 for cavity resonators 320 may be coupled to resonator 325 at its lower left and upper fight vertices, dielectric support 210 for cavity resonators 330 may be coupled to resonator 335 at its upper left and lower right vertices. Other support arrangements may be used, provided that resonators 325, 335 are suspended within their respective cavities without touching any conductive walls.

Figure 4:
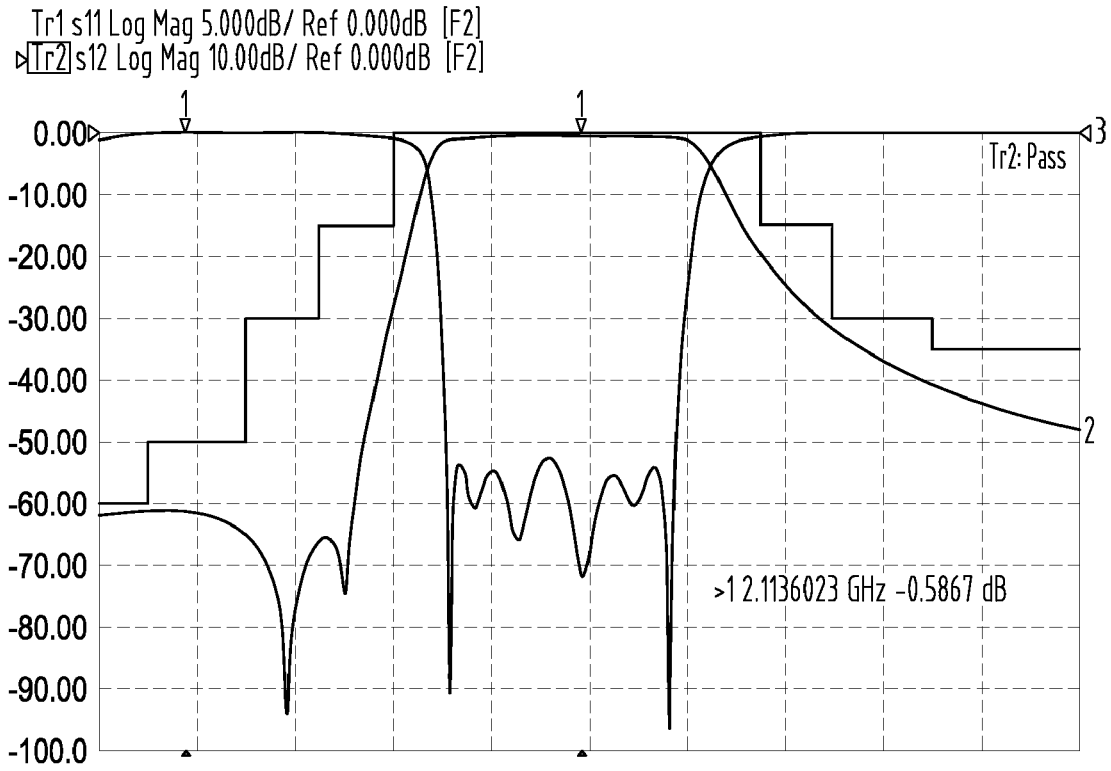
FIG. 4 shows the passband frequency response of the filter of FIG. 3.

FIG. 4 depicts the passband frequency response of filter 300 of FIG. 3. In various exemplary embodiments, the bandpass filter has a passband stretching from roughly 2150 MHz to 2220 MHz. Thus, it may have a bandwidth of approximately 70 MHz. Within the passband, the frequency response curve includes six minima, corresponding to its six poles. Suitable design of the cavity's dimension may allow these frequencies to be varied.

Figure 5:
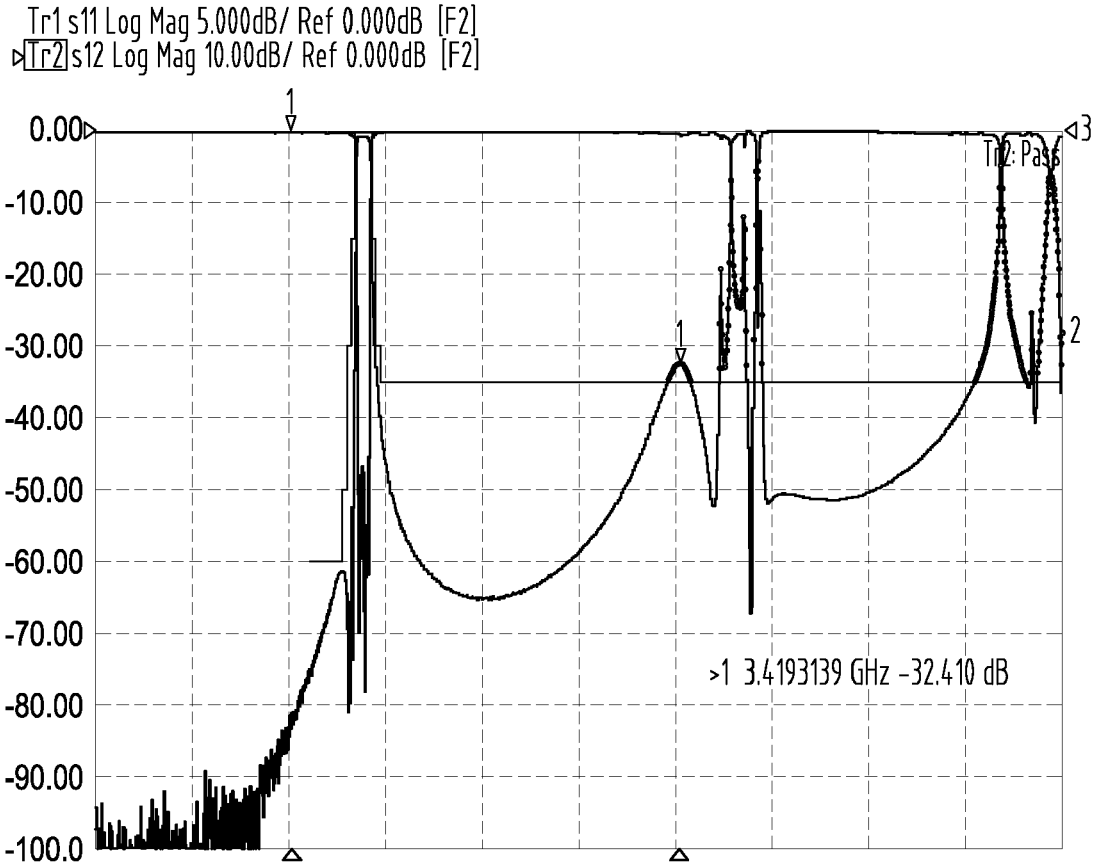
FIG. 5 shows the wideband frequency response of the filter of FIG. 3.

FIG. 5 depicts the wideband frequency response of filter 300 of FIG. 3. Using a metallic resonator instead of a ceramic resonator greatly improves the wideband frequency response. As depicted in FIG. 5, unwanted signals only become a significant factor at a frequency of about 3.4 GHz. In contrast, a filter using a ceramic resonator allows unwanted frequencies as low as 2.5 GHz to interfere with the desired signal. Thus, the exemplary filter rejects a much wider band of unwanted frequencies.

Figure 6A:
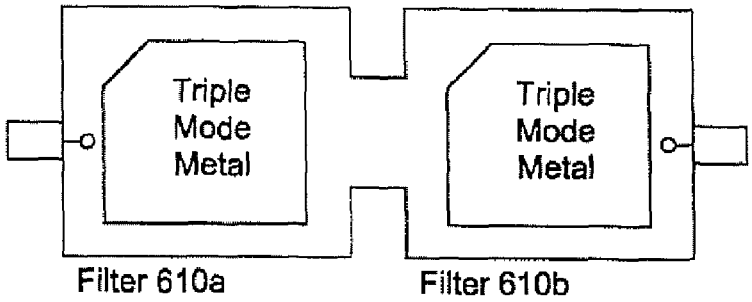
FIG. 6A shows an exemplary six-pole filter.

FIG. 6A shows an exemplary six-pole filter 610 similar to filter 300 of FIG. 3. In this exemplary embodiment, irises couple two triple-mode cavity resonators 610*a*, 610*b* to form filter 610 having six poles. Both cavity resonators 610*a*, 610*b* have central metal blocks as resonators.

Figure 6B:
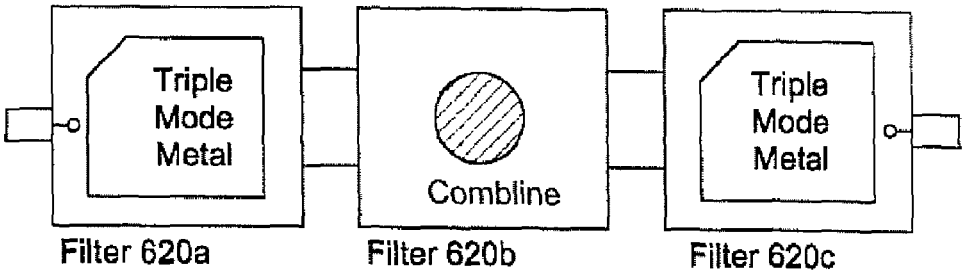
FIG. 6B shows an exemplary seven-pole filter.

FIG. 6B shows an exemplary seven-pole filter 620. In this exemplary embodiment, irises couple two triple-mode cavity resonators 620*a*, 620*c* to a combline filter 620*b* so that combline filter 6201) is between cavity resonators 620*a*, 620*c*. Thus, resulting bandpass filter 620 has seven poles. Both cavity resonators 620*a*, 620*c* have central metal blocks as resonators.

Figure 6C:
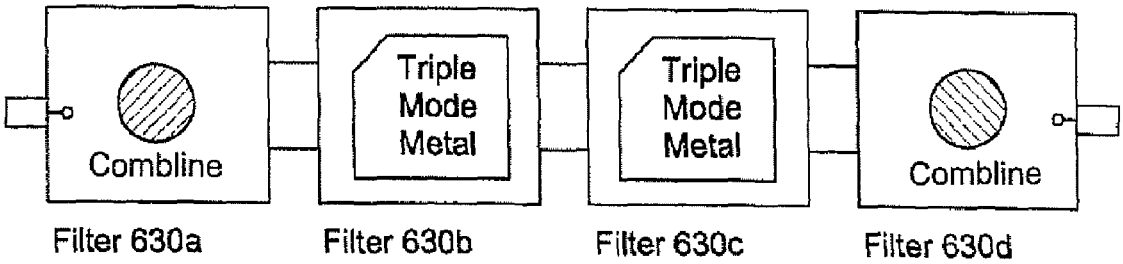
FIG. 6C shows an exemplary eight-pole filter.

FIG. 6C shows an exemplary eight-pole filter 630. In this exemplary embodiment, combline filters 630*a*, 630*d* are connected to terminals and linked to each other by a pair of triple-mode cavity resonators 630*b*, 630*e*. An iris couples the cavity resonators 630*b*, 630*e* to each other. Thus, bandpass filter 630 has eight poles. Both cavity resonators 630*b*, 630*e* have central metal blocks as resonators.

Figure 6D:
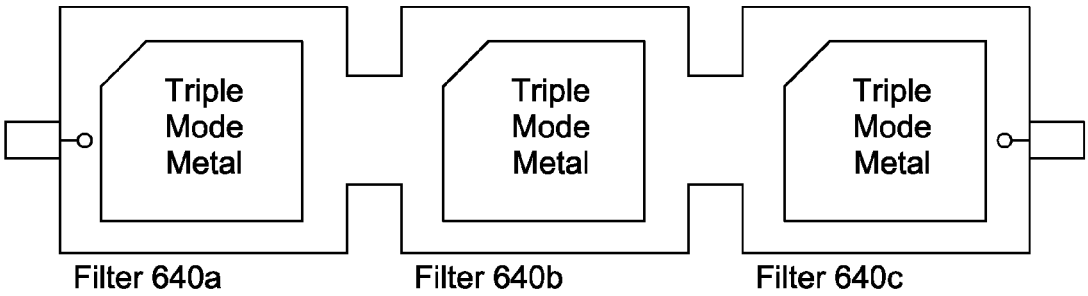
FIG. 6D shows an exemplary nine-pole filter having three metal resonators.

FIG. 6D shows an exemplary nine-pole filter 640 having three metallic resonators. In this exemplary embodiment, irises couple three triple-mode cavity resonators 640*a*, 640*b*, 640*c*, forming nine-pole filter 640. All of the cavity resonators 640*a*, 640*b*, and 640*c* have central metal blocks as resonators.

Figure 6E:
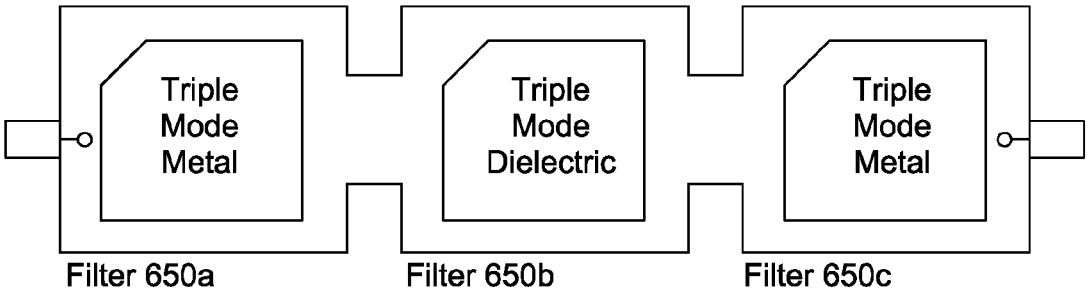
FIG. 6E shows an exemplary nine-pole filter having two metal resonators.

FIG. 6E shows an exemplary nine-pole filter 650 having two metallic resonators. In this exemplary embodiment, irises couple three triple-mode cavity resonators 650*a*, 650*b*, 650*c*, forming nine-pole filter 650. While filter 650*b* has a ceramic central block, the resonators of cavity resonators 650*a*, 650*c* are metallic blocks.

Figure 6F:
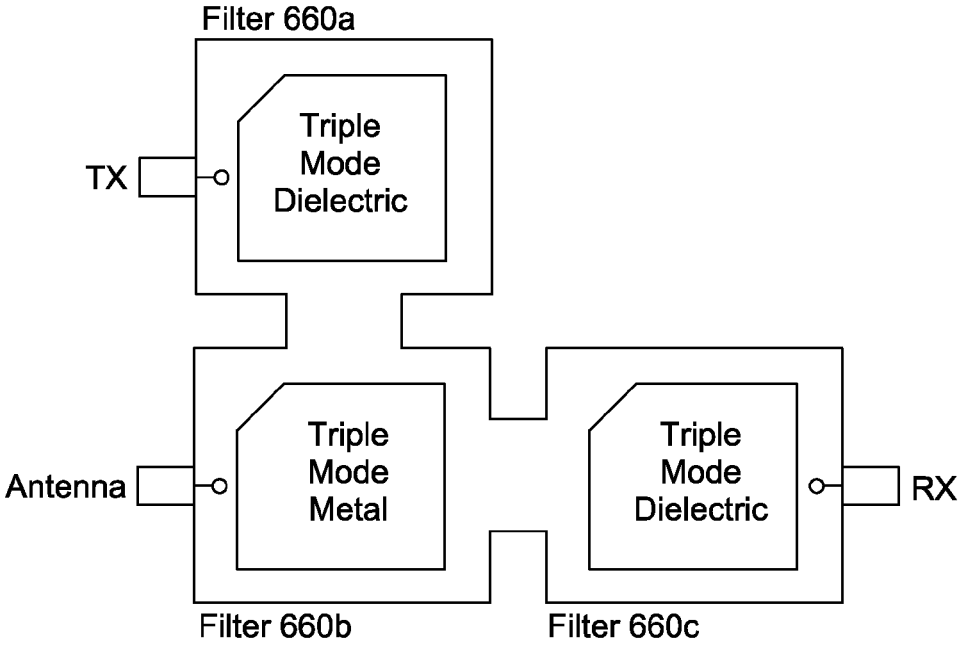
FIG. 6F shows an exemplary nine-pole filter having one metal resonator.

FIG. 6F shows an exemplary nine-pole filter 660 having one metal resonator. In this exemplary embodiment, irises couple three triple-mode cavity resonators 660*a*, 660*b*, 660*c*, forming nine-pole filter 660. While filter 660*b* has a metallic central block, cavity resonators 660*a*, 660*c* have ceramic resonators. Stead of being arranged in a straight line, the irises are orthogonal. Thus, resonators 660*a*, 660*c* are at a right angle relative to resonator 660*b*.

Figure 6G:
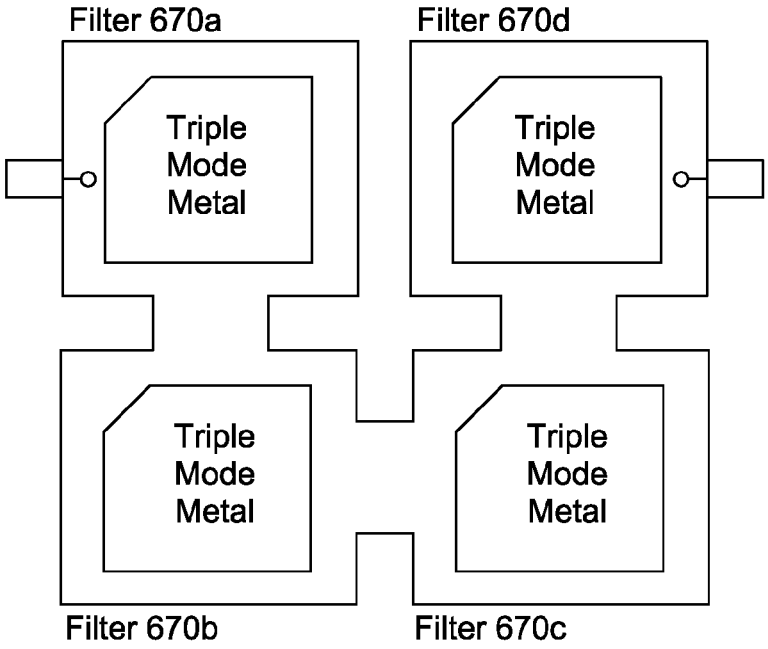
FIG. 6G shows an exemplary twelve-pole filter having four metal resonators.

FIG. 6G shows an exemplary twelve-pole filter 670 having four metallic resonators. In this exemplary embodiment, irises couple four triple-mode cavity resonators 670*a*, 670*b*, 670*c*, 670*d* to form twelve-pole filter 670. All of the resonators 670*a*, 670*b*, 670*c*, and 670*d* have central metal blocks. Resonators 670*a*, 670*b*, 670*c*, 670*d* are arranged in a U-shaped pattern, having connections defined from upper-left to lower-left, lower-left to lower-right, and lower-right to upper-right.

Figure 6H:
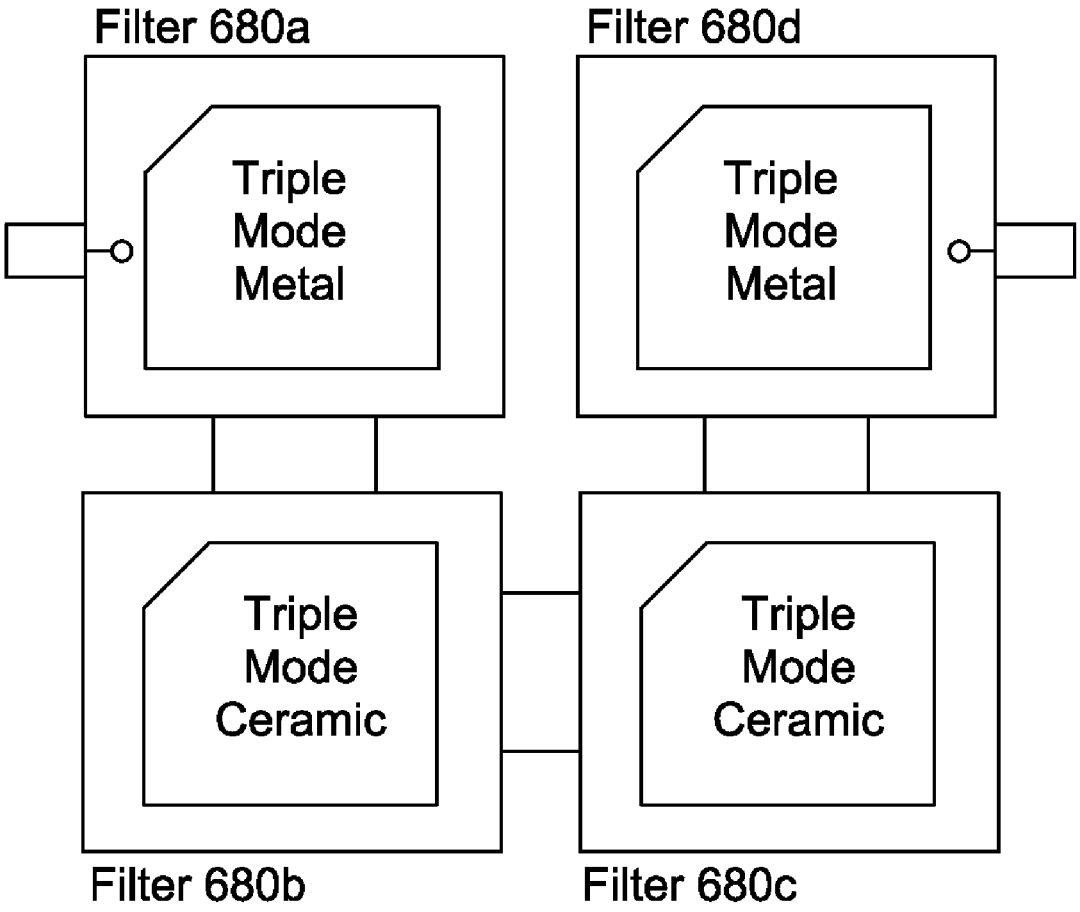
FIG. 6H shows an exemplary twelve-pole filter having two metal resonators.

FIG. 6H shows an exemplary twelve-pole filter 680 having two metallic resonators. In this exemplary embodiment, irises couple four triple-mode cavity resonators 680*a*, 680*b*, 680*c*, 680*d* to form twelve-pole filter 680. Resonators 680*a*, 680*b*, 680*c*, 680*d* have a U-shaped pattern, being connected from upper-left to lower-left, lower-left to lower-right, and lower-right to upper-right. While the resonators of cavity resonators 680*b*, 680*c* are ceramic, cavity resonators 680*a*, 680*d* have metallic resonators.

According to the forgoing, various exemplary embodiments provide numerous advantages over conventional bandpass filters. Compared to triple-mode filters with ceramic resonators, triple-mode filters with metallic resonators have a greatly improved spurious response. While ceramic resonators tend to produce higher-order resonant frequencies near the passband, metallic resonators eliminate the need for strict spurious suppression techniques because their resonant frequencies are further away. Thus, a metallic resonator can provide a wide, spurious-free window, a characteristic that is highly desirable for a bandpass filter.

Furthermore, in various exemplary embodiments, a combination of ceramic and metallic resonators results in synergism, creating a better filter with improved characteristics not found when using only one type of filter. A bandpass filter mixing both ceramic and metallic resonators could benefit from the high Q-factor of the ceramic resonator while also exhibiting the wide, spurious-free window of the metallic resonator. Additional benefits may be obtained by combining combline filters with cavity filters having triple-mode metallic resonators.

Although the various exemplary embodiments have been described in detail with particular reference to certain exemplary aspects thereof, it should be understood that the invention is capable of other different embodiments, and its details are capable of modifications in various obvious respects. As is readily apparent to those skilled in the art, variations and modifications can be affected while remaining within the spirit and scope of the invention. Accordingly, the foregoing disclosure, description, and figures are for illustrative purposes only, and do not in any way limit the invention, which is defined only by the claims.

What is claimed is:

1. A triple-mode cavity resonator for selecting a specific range of signal frequencies, said filter comprising:

at least one metallic wall for defining a cavity that confines electromagnetic waves;

a resonator located within said cavity without contacting said at least one metallic wall, wherein said resonator is selected from the group consisting of a metallic resonator and a metal-plated polymer resonator and is substantially cubical in shape; and a support element coupling said resonator to said cavity.

2. The cavity resonator of claim 1, wherein said cavity is a rectangular parallelepiped having a top surface, a bottom surface, and four side surfaces.

3. The cavity resonator of claim 1, wherein said cavity is coupled through cuts in various vertices of said substantially cubical resonator to achieve different coupling values.

4. The cavity resonator of claim 3, wherein said cuts are chamfers.

5. A six-pole bandpass filter having a particular bandwidth over a selected range of frequencies, said bandpass filter comprising:

a first triple-mode cavity resonator;

a second triple-mode cavity resonator; and an iris to couple signals between said first and second cavity resonators, wherein each of said cavity resonators comprises:

at least one metallic wall for defining an enclosed cavity that confines electromagnetic waves, a metallic resonator located within said cavity without contacting said at least one metallic wall, wherein said metallic resonator is substantially cubical in shape, and a support element coupling said metallic resonator to said cavity.

6. The bandpass filter of claim 5, wherein said cavity is a rectangular parallelepiped having a top surface, a bottom surface, and four side surfaces.

7. A multi-pole bandpass filter comprising:

a plurality of terminals;

at least one triple-mode cavity resonator comprising:

at least one metallic wall for defining a cavity that confines electromagnetic waves, a metallic resonator located within said cavity without contacting said at least one metallic wall, wherein said metallic resonator is substantially cubical in shape, and a support element coupling said metallic resonator to said cavity; and a plurality of irises for coupling said at least one cavity resonator to said plurality of terminals.

8. The bandpass filter of claim 7, wherein said bandpass filter comprises:

two triple-mode cavity resonators, each said cavity resonator having a metallic resonator, and a combline resonator.

9. The bandpass filter of claim 7, wherein said bandpass filter comprises:

two triple-mode cavity resonators, each said cavity resonator having a metallic resonator, and two combline resonators.

10. The bandpass filter of claim 7, wherein said bandpass filter comprises:

a first cavity resonator having a first resonator;

a first iris coupling said first cavity resonator to a second cavity resonator, said second cavity resonator having a second resonator; and a second iris coupling said second cavity resonator to a third cavity resonator, said third cavity resonator having a third resonator.

11. The bandpass filter of claim 10, wherein said first, second, and third resonators are metallic.

12. The bandpass filter of claim 10 wherein said first and third resonators are metallic and said second resonator is ceramic.

13. The bandpass filter of claim 10, wherein said first and third resonators are ceramic and said second resonator is metallic.

14. The bandpass filter of claim 7, wherein said bandpass filter comprises four triple-mode cavity resonators, each cavity resonator having a metallic resonator.

15. The band pass filter of claim 7, wherein said filter comprises:

two triple-mode resonators having metallic resonators; and two triple-mode resonators having ceramic resonators.

* * * * *